US006295672B1

(12) United States Patent
Vassallo, Jr.

(10) Patent No.: US 6,295,672 B1
(45) Date of Patent: Oct. 2, 2001

(54) REMOVABLE SPINE BOARD FOOT SUPPORT

(76) Inventor: Robert E. Vassallo, Jr., 54 Parlmont Park, Billerica, MA (US) 01821

( * ) Notice: Subject to any disclaimer, the term of this patent is extended or adjusted under 35 U.S.C. 154(b) by 0 days.

(21) Appl. No.: 09/518,660

(22) Filed: Mar. 3, 2000

(51) Int. Cl.[7] ..... A61G 1/04; A61G 1/00
(52) U.S. Cl. ..... 5/626; 5/624; 5/651; 128/845
(58) Field of Search ..... 5/626, 625, 651, 5/621, 624, 622, 623; 128/845, 870, 882

(56) References Cited

U.S. PATENT DOCUMENTS

| | | | | |
|---|---|---|---|---|
| 2,911,657 | * | 11/1959 | Streeter, III | 5/651 |
| 3,523,311 | * | 8/1970 | Ricke | 5/651 |
| 3,609,778 | * | 10/1971 | Zeiner | 5/626 |
| 4,369,982 | | 1/1983 | Hein et al. . | |
| 5,154,186 | | 10/1992 | Laurin et al. . | |
| 5,201,089 | | 4/1993 | Ferreira . | |
| 5,342,290 | | 8/1994 | Schuellein . | |
| 5,673,447 | * | 10/1997 | White et al. | 5/651 |
| 5,871,220 | | 2/1999 | Lombard . | |
| 6,000,399 | * | 12/1999 | Choy | 5/651 |
| 6,032,309 | * | 3/2000 | Michelson | 5/621 |

* cited by examiner

*Primary Examiner*—Alexander Grosz
(74) *Attorney, Agent, or Firm*—Mark P. White

(57) ABSTRACT

A removable foot support provides vertical stability for trauma victims carried on spine boards. The foot support is a unitary L-shaped structure having a vertical section, and a horizontal section at right angles to the vertical section. The vertical section is provided with two or more pins, which mate with sleeves inserted into the spine board. The mating sleeves and pins are provided with locking means comprised of detent means or cotter pins. In use the trauma victim is first placed on the board, and the foot rest is then attached. A tether chain or cable may be used to loosely affix the foot rest to the board.

6 Claims, 5 Drawing Sheets

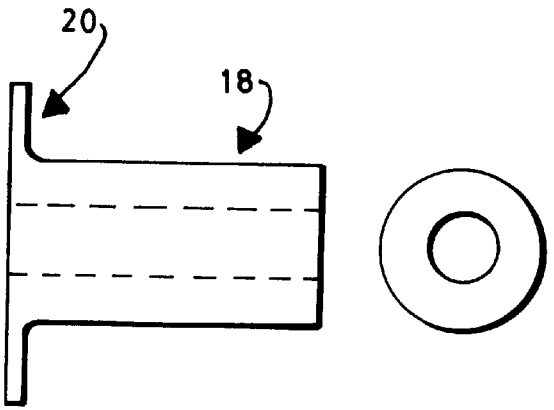
FIG. 5a
FIG. 5b
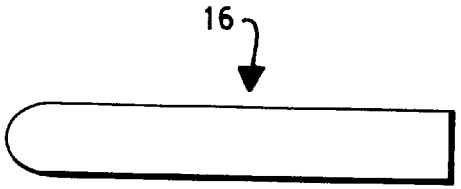
FIG. 5c
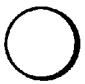
FIG. 5d

REMOVABLE SPINE BOARD FOOT SUPPORT

BACKGROUND OF THE INVENTION

1. Field of the Invention

The present invention relates to devices for restraining trauma victims, and more particularly to such devices which provide foot support and vertical stability where the trauma involves spinal injury.

2. Description Relative to the Prior Art

Spine board, or backboards, are commonly used by rescue personnel to restrain and carry victims of spinal and trauma. When such spinal injury occurs, is important that the victim be immobilized for transport to a treatment center, so that the victim does not suffer further injury during movement and transportation to the treatment center. This is especially important in cases of injuries to the cervical area, where relatively small movements of the head may result in permanent injury to the spinal column.

In many instances the approved procedure involving patients encountered standing at the scene of an accident is to fit the victim with a cervical collar, and secure the victim at the head, pelvis, and feet to the spine board while till in the standing position. The victim may then be put into a horizontal position.

In other cases the victim may be encountered at the accident scene in a horizontal position. The victim must be first have the cervical collar attached, and then be slid onto the spine board, being finally strapped down.

The most commonly-used spine board, as shown in FIG. 1, is a flat piece of plywood or plastic 2, an inch or two in cross-section, with hand-holes 4 located along the sides, and with restraining straps 6 provided for restraint.

A common problem in the use of such a board, however, is the lack of restraint in the vertical, or major body axis, direction. When the victim is placed on the board standing up, it is critical than he not slide, relative to the spine board, when the board is tilted onto a vertical orientation.

Even after the victim is placed in a horizontal position, he is often not carried in a such a strictly horizontal position. It is often necessary to tilt the spine board, even sometimes into the vertical position. Furthermore, acceleration or deceleration in the ambulance, or other rescue vehicle, can exert vertical forces on the victim. Under such circumstances the victim may tend to slide vertically with respect to the spine board, thus defeating the purpose of the other restraints.

Attempts have been made to remedy this situation by providing a foot rest at one end of the spine board. A number of inventions have described folding brackets attached to the spine board, which can be folded up after the victim is on the spine board. These folding foot rests suffer from the problem that they prevent sliding of the victim along the length of the spine board, since they project off the surface.

Other attempts have been made to offer a removable foot rest which may be attached after the victim is on the spine board. In particular, the inventions of Ferreira, U.S. Pat. No. 5,201,089, and Hein, U.S. Pat. No. 4,369,982, describe such removable foot rests.

The present invention is an improvement over such prior-art removable foot rests, as it is inexpensive, simple to use, and may be tethered to the spine board so that it is not lost or misplaced when needed.

SUMMARY OF THE INVENTION

It is an object of the current invention to provide a spine board with a foot rest which may be attached when required to the board, but removed from the board at other times when its presence may inhibit proper use of the board.

In accordance with one aspect of the invention, a device for immobilizing and transporting trauma victims includes a spine board and a bracket having an L-shaped cross section. The L-shaped bracket further includes a horizontal member and a vertical member, with the vertical member rigidly attached at a right angle to the horizontal member, and there are a multiplicity of pins, affixed at one end of the vertical member.

The spine board has a multiplicity of sleeves formed into the board at one end, into which the pins are inserted. In this way the pins removeably attach the foot support to mating holes in the sleeves.

According to a second aspect of the invention, the device further includes locking means to secure the pins in the mating holes in the sleeves.

According to a third aspect of the invention, the bracket, pins, and sleeves are all fabricated from stainless steel.

According to a fourth aspect of the invention, the pins are affixed to the L-shaped bracket by welding, and the horizontal member is affixed to the vertical member by welding.

According to a fifth aspect of the invention, the locking means further includes detents.

According to a sixth aspect of the invention, the locking means further includes cotter pins.

According to a seventh aspect of the invention, there are included clip means for securing the bracket to the spine board when the bracket is not attached by means of the pins and sleeves.

According to a final aspect of the invention, the bracket and sleeves are provided as a kit to modify existing spine boards.

BRIEF DESCRIPTION OF THE DRAWINGS

These, and further features of the invention, may be better understood with reference to the accompanying specification and drawings depicting the preferred embodiment, in which:

FIGS. 5*a* and 5*b* show side and end cross sectional views of a sleeve element that is inserted into the spine board.

FIGS. 5*c* and 5*d* show side and end cross sectional views of a pin element that is insertable in a sleeve element.

DETAILED DESCRIPTION OF THE PREFERRED EMBODIMENTS

Figure 1:
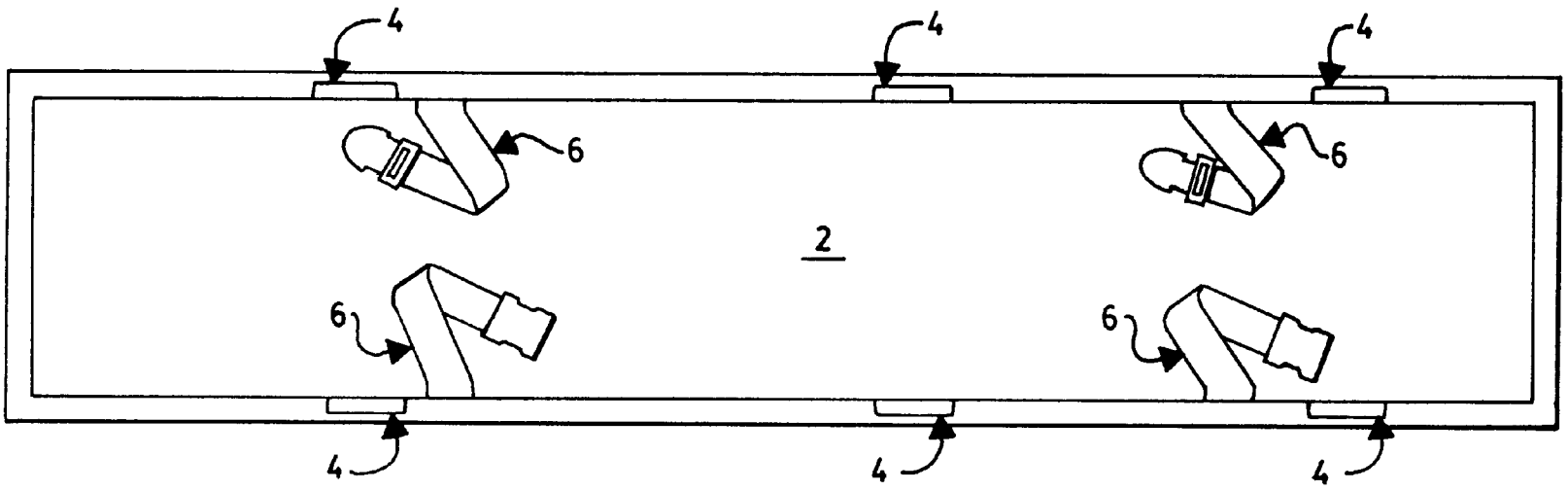
FIG. 1 (PRIOR ART)
FIG. 1 depicts the prior art spine board, having hand holds and restraint straps.
Figure 2:
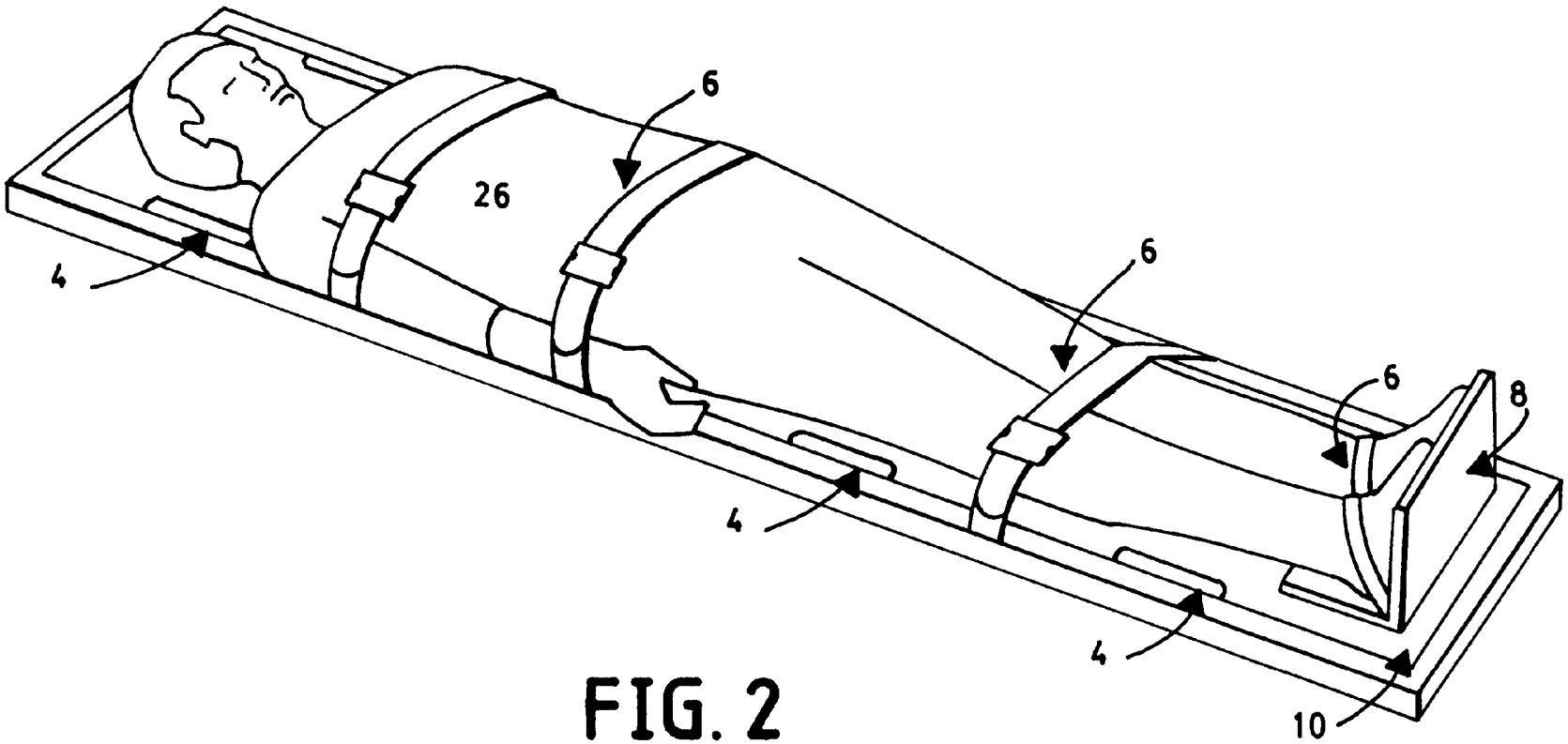
FIG. 2 depicts a perspective view of a patient restrained on a spine board adapted with the present invention.

In its most basic embodiment, the invention includes an L-shaped bracket which is attached to the spine board. Referring first to FIG. 2, it is seen that the foot rest is attached at the foot-end 10 of the spine board.

Figure 3:
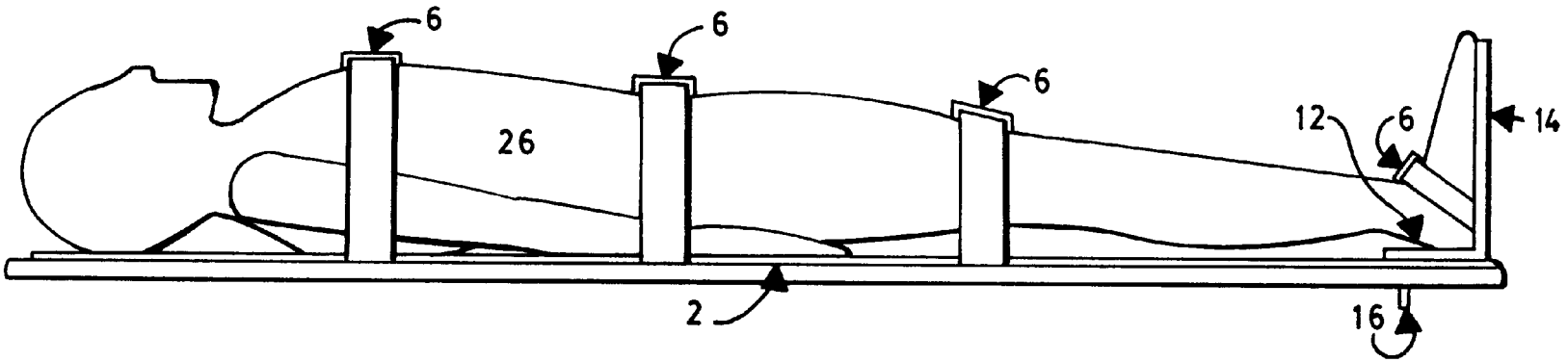
FIG. 3. shows a cross-section view of a patient restrained on a spine board adapted with the present invention.

The cross sectional view, depicted in FIG. 3, shows the foot rest supporting the feet of the patient secured to the spine board. The foot rest has a vertical member 12, which lies flush with the foot end of the spine board. The horizontal member 14, at right angles to the vertical member, supports the bottom of the feet of the patient 26. The bracket is attached to the spine board by means of two pins 16.

Figure 4:
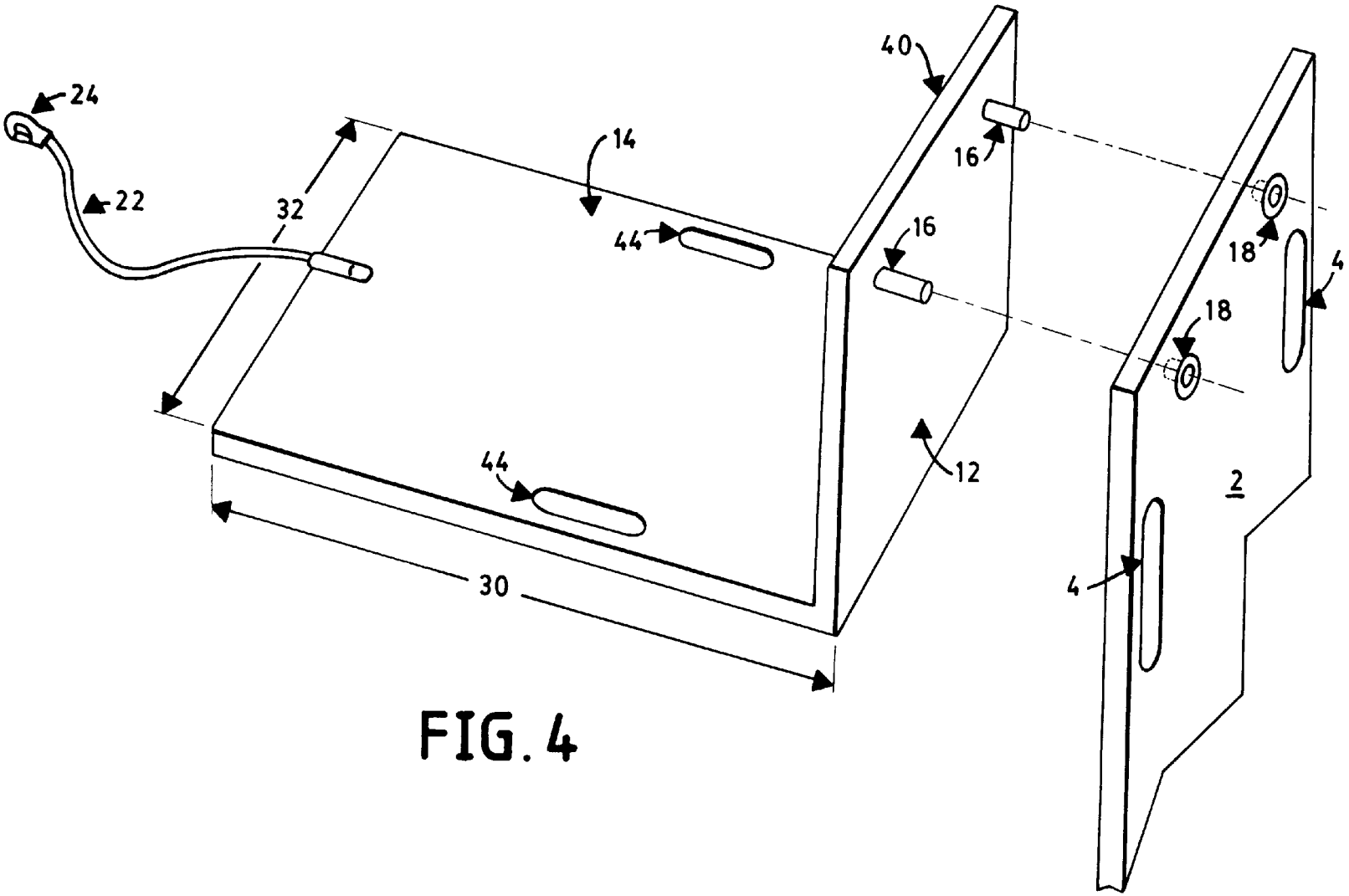
FIG. 4 depicts a perspective view of the foot rest.

The foot rest assembly may be understood by referring now to FIG. 4. The horizontal member 14, like the rest of the bracket, is fabricated from stainless steel, which is preferred to other materials for durability. Stainless steel is also rustproof, and can be easily decontaminated. In this embodiment, the horizontal member is ten inches in length 30, and six inches in width 32.

Still referring to FIG. 4, the vertical member 12 is welded to the horizontal member to form the L-shaped bracket. Heliarc welding is the preferred method of attachment. The vertical member, like the horizontal member, is six inches in width. Affixed to the outer face of the vertical member are two pins 16, which are spaced four inches apart, and about one-half inch from the outer edge 40 of the vertical member. These pins are used to attach the foot rest to the spine board 2, by mating with two sleeves 18, which are inserted into the foot end of the spine board.

The pins in this embodiment are three-eighths of an inch in diameter, and one inch in length. The pins are attached to the heliarc welded to the vertical member, and are also made of stainless steel, for the same reasons as previously stated. The sleeves are press-fit into the spine board, and have an inner diameter of slightly greater than three-eighths of an inch, so that the pins exactly fit into the sleeves. The sleeves are shown in more detail in FIG. 5*a,* and the pins in FIG. 5*b.* Referring to these figures, it is seen that the pins 16 have a tapered end, to ease entry into the sleeves. The sleeves 18 have a flange 20 at one end, to prevent the sleeves from pushing through the spine board. The sleeve are aligned at the surface of the spine board from which the pins are inserted.

Referring again to FIG. 4, the foot rest also contains an elongated flexible tether means such as a cable 22, attached to the horizontal member, with a snap hook 24 affixed to the end of the cable, so that the foot rest may be tethered to a mating hole in the spine board when the foot rest is not affixed to the board. Two slots 44 on either side of the horizontal member accommodate straps to secure the feet to the foot rest.

Prior to use of the foot rest the spine board must be modified by first drilling the board to accommodate the two sleeves. The sleeves are located at least two and one-half inches from the foot-end of the board, and are spaced four inches apart, symmetrically about the longitudinal center line of the board. As previously stated, the flanges are oriented on the surface into which the pins are inserted, the same surface on which the patient lies. After insertion, the non-flange end of the sleeves may be swaged over to capture the board between the two ends of the sleeve.

In other embodiments, provisions are made to positively lock the pins into the sleeves. In one embodiment, the pins contain a recess near the outer end, and the sleeves contain detents which mate with the recesses when the pins are fully inserted into the sleeves. Other locking methods include cotter pins which insert into holes drilled perpendicularly to the long axis of the pins.

While the invention has been described with reference to specific embodiments, it will be apparent that improvements and modifications may be made within the purview of the invention without departing from the scope of the invention defined in the appended claims.

What is claimed is:

1. A device for immobilizing and transporting trauma victims comprising:

a spine board;

a bracket having an L-shaped cross section, further comprising a horizontal member and a vertical member, the vertical member rigidly attached at a right angle to the horizontal member;

a multiplicity of pins, affixed at one end of said vertical member;

a multiplicity of sleeves, into which the pins are inserted, the sleeves inserted into the spine board so that the pins removeably attach the foot support to mating holes in the sleeves detent locking means adapted to removably secure said pins in mating holes in said sleeves, and elongated flexible tether means adapted to secure said bracket, to the spine board when the bracket is not attached to the spine board by the means of the pins and sleeves.

2. The device of claim 1, wherein the bracket, pins, and sleeves are all fabricated from stainless steel.

3. The device of claim 1, wherein the pins are affixed to the L-shaped bracket by welding, and wherein the horizontal member is affixed to the vertical member by welding.

4. A device for immobilizing and transporting trauma victims comprising:

a spine board;

a bracket having an L-shaped cross section, further comprising a horizontal member and a vertical member, the vertical member rigidly attached at a right angle to the horizontal member;

a multiplicity of pins, affixed at one end of said vertical member;

a multiplicity of sleeves, into which the pins are inserted, the sleeves inserted into the spine board so that the pins removeably attach the foot support to mating holes in the sleeves; cotter pin locking means adapted to removably secure said pins in mating holes in said sleeves, and elongated flexible tether means adapted to secure said bracket to the spine board when the bracket is not attached to the spine board by the means of the pins and sleeves.

5. The device of claim 4, wherein the bracket, pins, and sleeves are all fabricated from stainless steel.

6. The device of claim 4, wherein the pins are affixed to the L-shaped bracket by welding, and wherein the horizontal member is affixed to the vertical member by welding.

* * * * *